US010513313B1

(12) United States Patent
Hunter et al.

(10) Patent No.: US 10,513,313 B1
(45) Date of Patent: Dec. 24, 2019

(54) FOAM CORE BARGE AND METHOD OF ASSEMBLY

(71) Applicants: Douglas R. Hunter, St. Johns, FL (US); Newman Stanley, Jacksonville, FL (US)

(72) Inventors: Douglas R. Hunter, St. Johns, FL (US); Newman Stanley, Jacksonville, FL (US)

( * ) Notice: Subject to any disclaimer, the term of this patent is extended or adjusted under 35 U.S.C. 154(b) by 0 days.

(21) Appl. No.: 16/217,171

(22) Filed: Dec. 12, 2018

(51) Int. Cl.
*B63B 5/24* (2006.01)
*B63B 3/12* (2006.01)
*B63B 3/04* (2006.01)

(52) U.S. Cl.
CPC ..... *B63B 5/24* (2013.01); *B63B 3/04* (2013.01); *B63B 3/12* (2013.01)

(58) Field of Classification Search
CPC ..... B63B 5/24; B63B 3/04; B63B 3/12
See application file for complete search history.

(56) References Cited

U.S. PATENT DOCUMENTS 3,435,470 A * 4/1969 Krenzler ..... B63B 5/24 114/357
3,668,051 A * 6/1972 Seemann, III ..... B63B 5/16 428/114
3,811,141 A * 5/1974 Stoeberl ..... B29C 65/56 114/357
4,228,788 A * 10/1980 Moeser ..... E04B 1/34363 123/437
4,715,307 A * 12/1987 Thompson ..... B63B 35/34 114/267
5,201,275 A * 4/1993 Mo ..... B63B 5/14 114/65 A
9,212,485 B2 * 12/2015 Wolynski ..... E04B 1/167
2015/0069647 A1 * 3/2015 Ciuperca ..... E04G 11/20 264/31
2015/0069664 A1 * 3/2015 Ciuperca ..... B28B 7/0032 264/333

* cited by examiner

*Primary Examiner* — S. Joseph Morano
*Assistant Examiner* — Jovon E Hayes
(74) *Attorney, Agent, or Firm* — Steven R. Scott

(57) ABSTRACT

The instant invention is a deck barge or other vessel formed using a core of styrofoam members stiffened by fiberglass cladding with said styrofoam/fiberglass core being partially clad in concrete, which concrete is reinforced with "L" or "U" shaped rebar over/around corners and which concrete is also sheathed on its exterior and interior sides by fiberglass matting that is concrete saturated during the process in order to produce a simple, easily manufactured design that is unsinkable, inexpensive, and carries substantial weight for its size. In the preferred embodiments, the concrete cladding entirely covers the port and starboard sides as well as the top/deck of the vessel and portions of the bottom.

16 Claims, 10 Drawing Sheets

FOAM CORE BARGE AND METHOD OF ASSEMBLY

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO MICROFICHE APPENDIX

Not Applicable.

BACKGROUND OF THE INVENTION

Field of the Invention

The instant invention pertains generally to barge construction, design and assembly. More particularly, the instant invention is directed to a deck barge design formed using a core of styrofoam members stiffened by fiberglass cladding with said styrofoam/fiberglass core being partially clad in concrete reinforced interior (typically "L" shaped) rebar over/around corners and by a sheath of fiberglass matting that is concrete saturated during the process in order to produce a simple, easily manufactured design that is unsinkable, inexpensive, and carries substantial weight for its size.

Relevant Art

Deck barges typically have a flat deck that can hold large amounts of heavy equipment (such as cranes), or transport goods (such as containers) held thereon. Thus, they find substantial use both for transportation and construction support. Such barges are typically constructed from steel. While most deck barges are constructed from steel, the use of ferro-cement construction for vessels dates back to the mid-1800s and might also have applicability. In this method, cement is typically applied over and through layer(s) of metal mesh and closely spaced steel rods such as rebar so as to fully permeate and surround the reinforcing metal elements used in order to construct structures in appropriate shapes for vessel hulls. Likewise, foam and fiberglass combinations have been in use for vessel construction for an extended period. Finally, fiberglass fibers have sometimes been mixed into concrete and/or concrete used in forming various structures, including floating docks, and such docks have been constructed using foam blocks over poured with a mixture, of concrete and fiberglass fibers. However, the costs involved in infusing concrete with fiberglass fibers and/or utilizing the amounts of steel mesh and rods typically used in ferro-cement construction adds substantially to the cost of construction, with ferro-cement not only adding substantial material costs but very substantial labor costs. Thus, there is a need for less expensive and less labor intensive construction techniques and better placement of reinforcing materials that will minimize or eliminate either or both. The inventor is not aware of any system using the methodology and producing a vessel having the characteristics and design of the instant invention.

SUMMARY OF THE INVENTION

The instant invention employs a unique combination and arrangement of foam members coated, protected by, and stiffened by layers of epoxy impregnated fiberglass fabric as the core of a new deck barge design that can carry substantially more additional weight than a deck barge constructed in accordance with known teachings in the art. This core serves as the inner portion of a concrete mold for a concrete shell that encases the sides, the upper deck, and portions of the bottom, bow and stern of the barge with a three inch thick layer of concrete. This layer differs in construction from both current ferro-cement designs and fiberglass impregnated concrete designs. As to the former, it is far lighter and more durable by virtue of its unique construction and the fact that it dispenses with the use of steel mesh as well as large amounts of rebar for reinforcement purposes. As to the former, it is not produced using concrete impregnated with fiberglass fibers. As to both, it differs by employing a unique placement of fiberglass fabric on the inner and outer surfaces of the concrete shell. This fiberglass fabric does not serve a the basis of an epoxy impregnated layer—instead it is infused/saturated with concrete during the concrete pour process, becoming concrete impregnated layers within and as part of the concrete shell that serve to increase the strength and durability of the shell and avoid the need to include fiberglass fibers in the concrete mix. Instead, fiberglass matting is place in locations where maximum stresses occur. Thus, my invention accomplishes the following objects and goals and/or provides the following benefits:

(1) It provides a stronger lighter form for, and system of construction for, a deck barge.

(2) It provides a form for, and system of construction for, a deck barge that is substantially less expensive given the rising cost of steel reinforcement used in ferro-cement type construction and the added costs for adding fiberglass fibers to concrete/cement.

(3) It provides a form for, and system of construction for, a deck barge where superior stiffness and durability is achieved in the styrofoam core by the use of a particular arrangement of epoxy coated styrofoam elements as taught herein.

(4) It provides a form for, and system of construction for, a deck barge where the rigid styrofoam core described above serves as the interior of a mold for most of its hull, which molded hull portions are comprised of concrete with fiberglass mat saturated by cement as part of its outer and inner surfaces.

(5) It provides a form for, and system of construction where, the foregoing features allow for minimal use of steel reinforcement, and that is characterized by ease and simplicity of manufacture leading to lower costs for manufacturing in terms of labor and required equipment.

(6) In view of all of the foregoing, it provides a form for, and system of construction for, a deck barge that is substantially less expensive and simpler to produce, while providing superior load bearing capacity and ruggedness.

These and other aspects of the inventive concept and goals can best be understood by reference to the drawing figures and description that follow.

BRIEF DESCRIPTION OF THE DRAWINGS

The novel features believed to be characteristic of this invention are set forth with particularity in the appended claims. The invention itself, however, both as to its organization and method of operation, together with further object and advantages thereof, may best be understood by reference to the following description taken in connection with the accompanying drawings in which:

DESCRIPTION

Figure 1A:
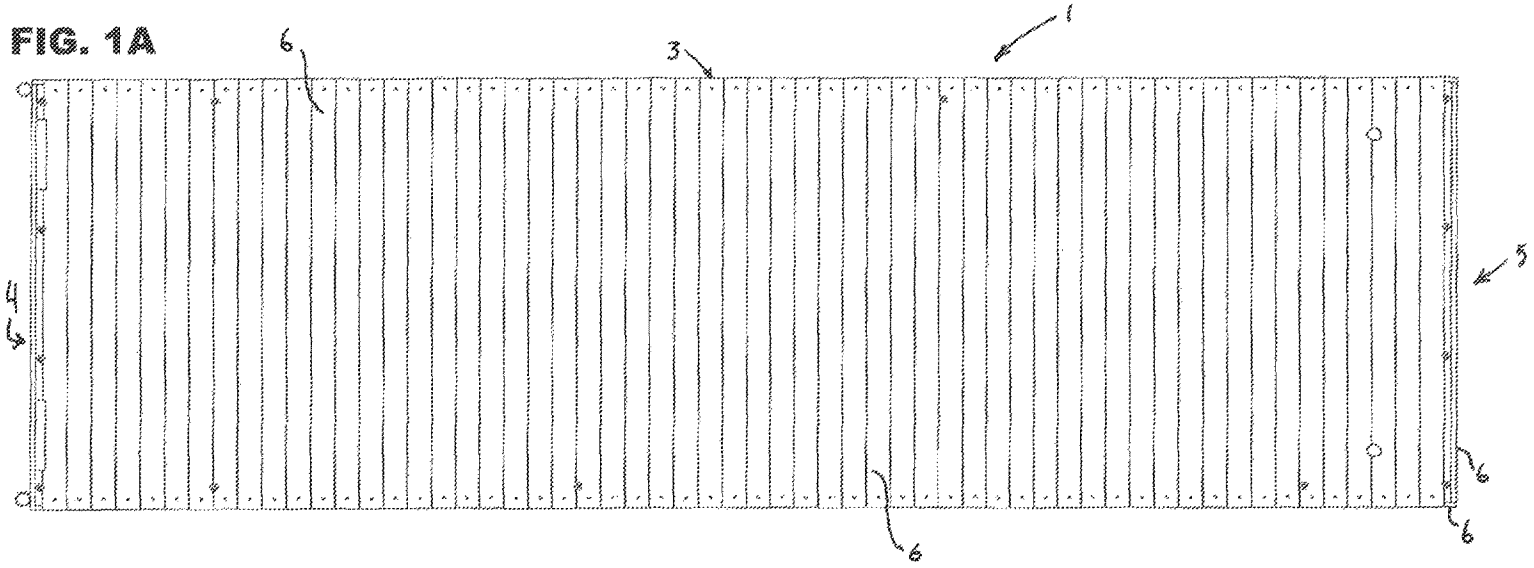
FIG. 1A provides a view from above of the external structures of a barge embodying the teachings of my invention.

Turning first to FIGS. 1A, 2A, 3A, 4A and 5A, providing external views of the deck barge 1 of my invention, it will be seen that barge 1 possesses a common exterior shape for a barge with flat bottom 2, sides 3, and rear (or stern 4), and a front (or bow 5) featuring an inclined entry plane 5A (which will contact and interface with water in which the barge floats when moving forward) terminating in a bow plate 5B adjacent deck 6. Further features related to each of these elements will be detailed after providing a more detailed review of the interior features/construction of barge 1.

Figure 1B:
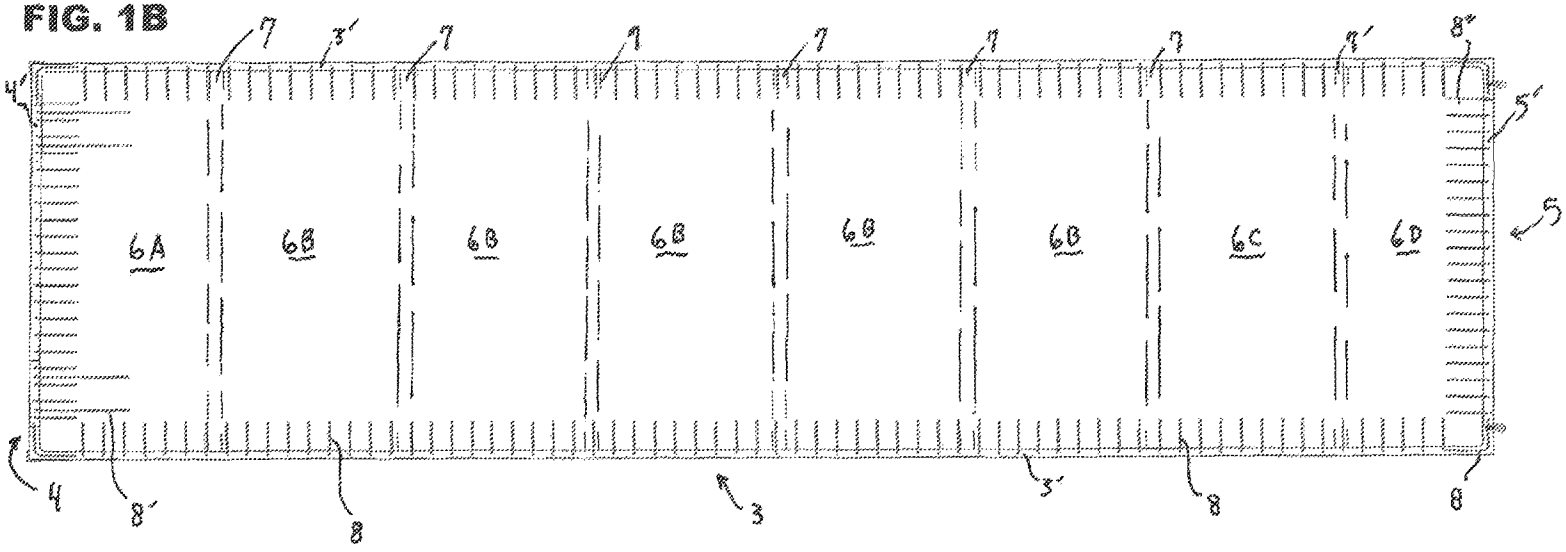
FIG. 1B provides a schematic view from above of the internal structures of said barge.
Figure 2A:
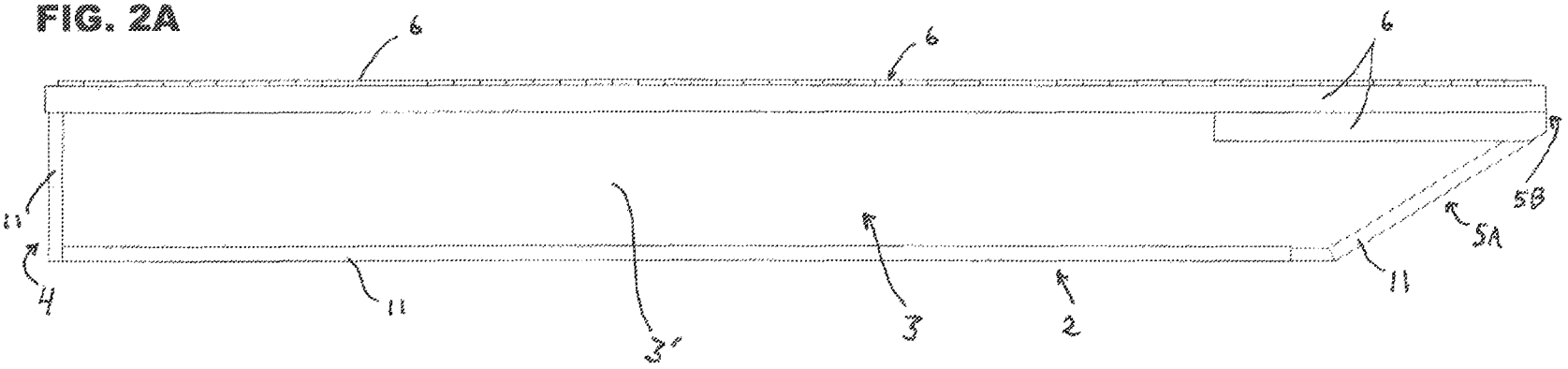
FIG. 2A provides a view from the side of the external structures of the barge.
Figure 2B:
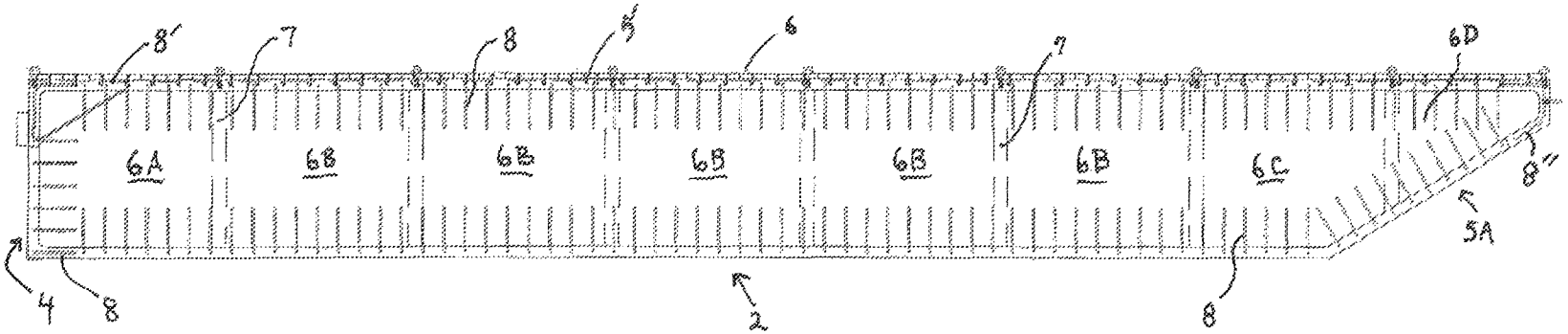
FIG. 2B provides a schematic view from the side of the internal structures of said barge.
Figure 3A:
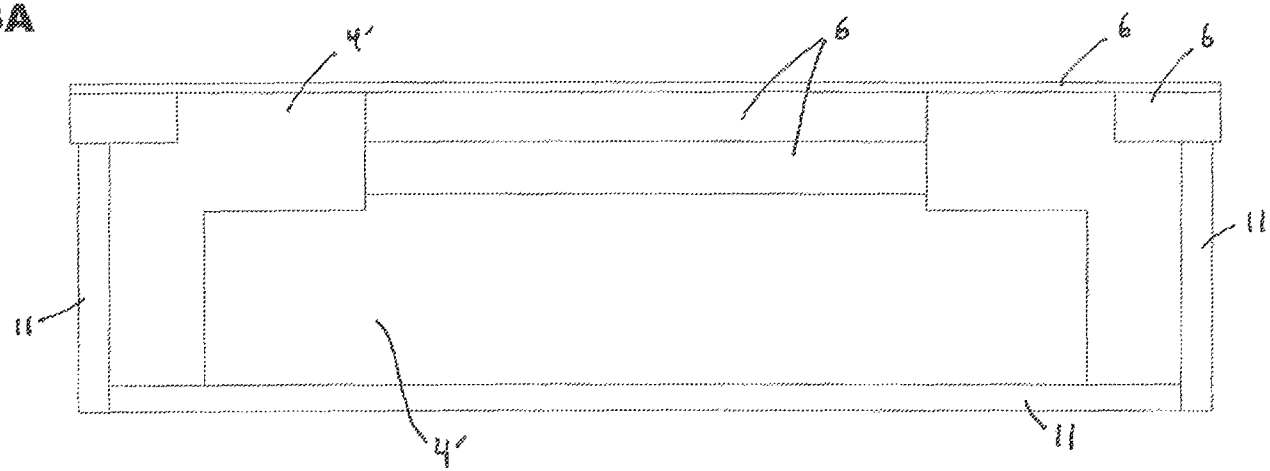
FIG. 3A provides a view from the rear of the external structures of said barge.
Figure 3B:
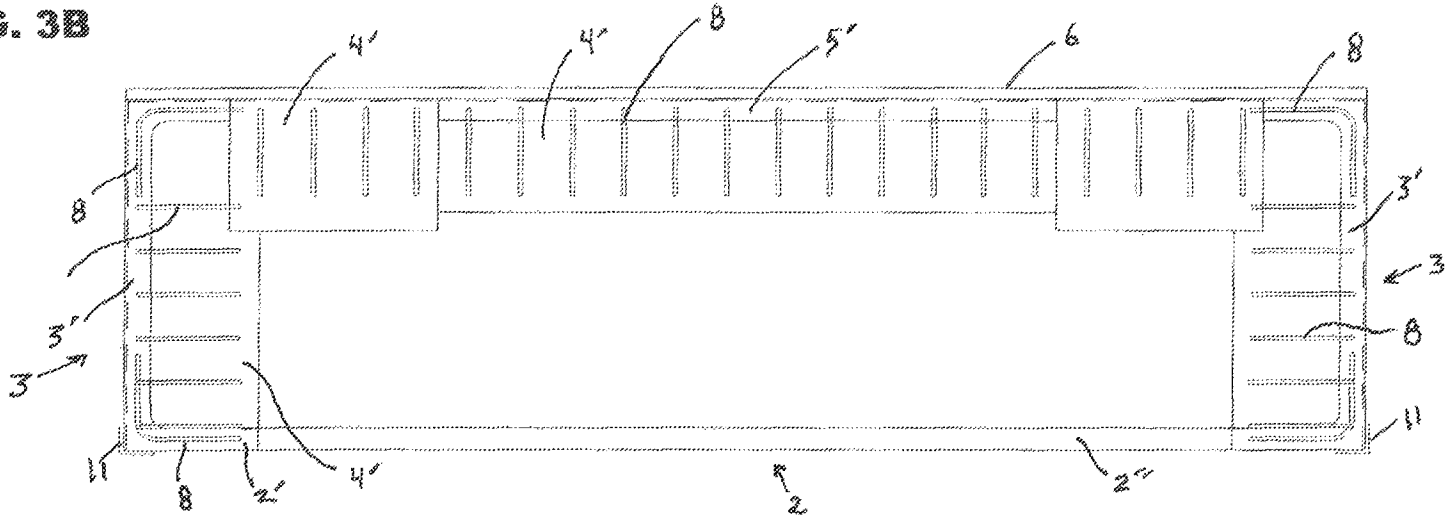
FIG. 3B provides a schematic view from the rear of the internal structures of said barge.
Figure 4A:
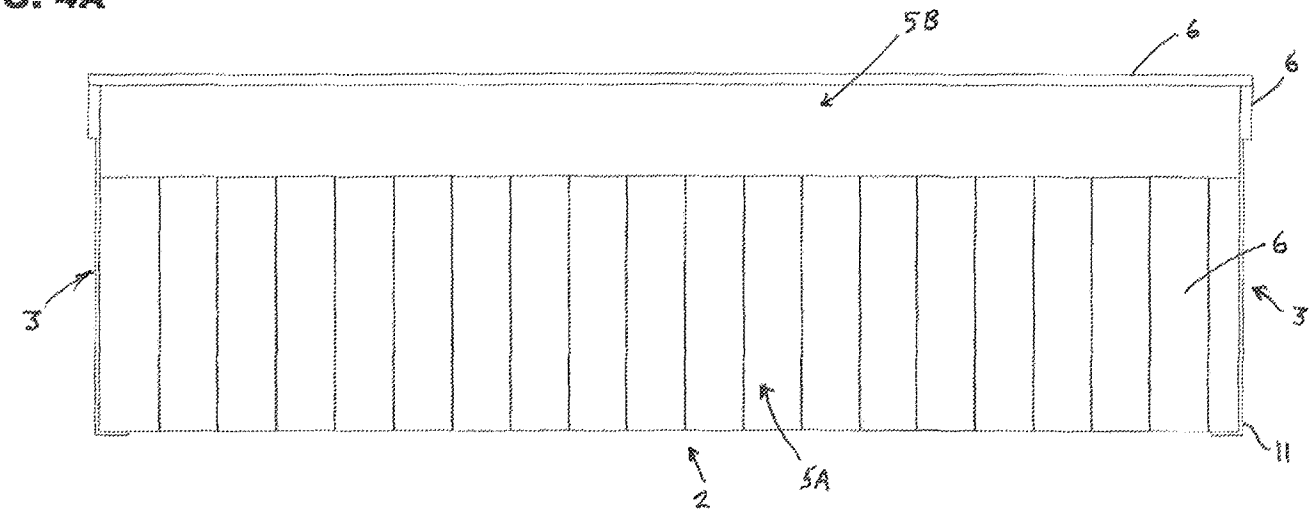
FIG. 4A provides a view from the front of the external structures of said barge.
Figure 4B:
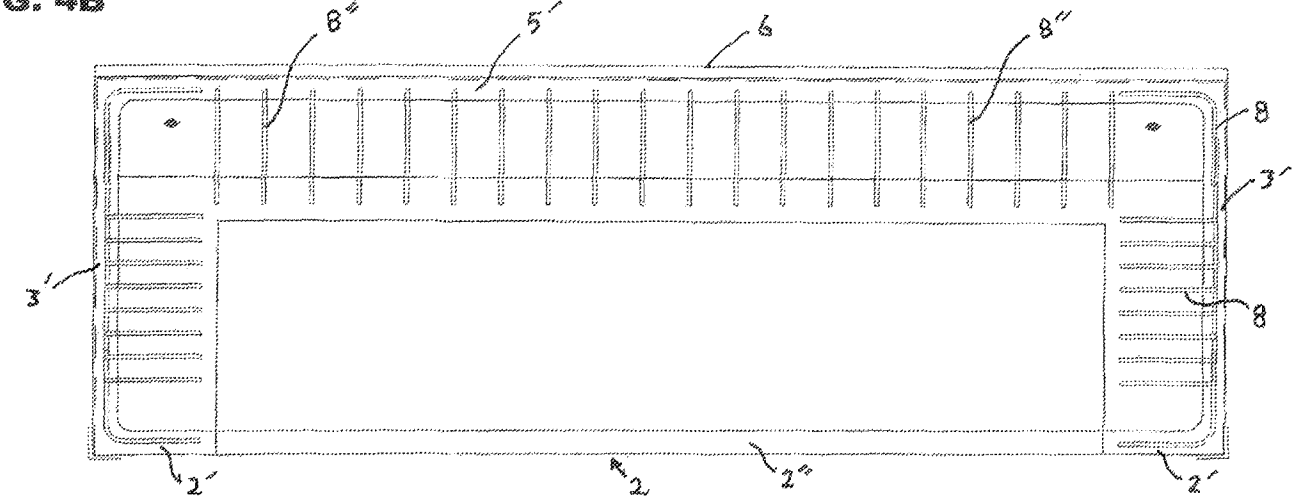
FIG. 4B provides a schematic view from the front of the internal structures of said barge.
Figure 5A:
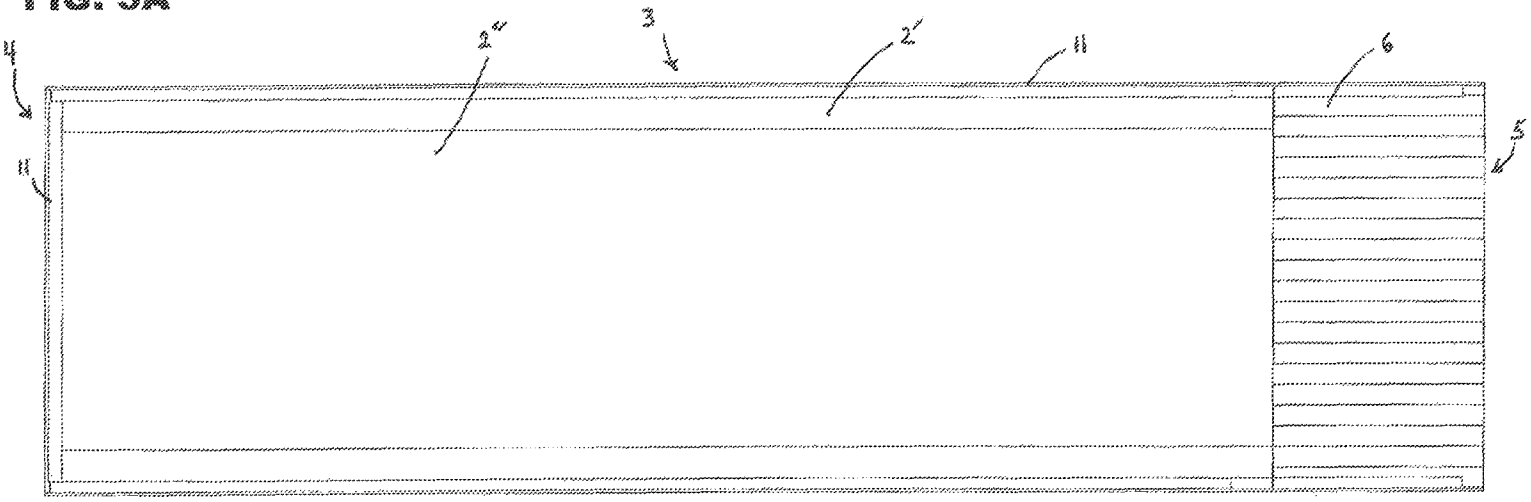
FIG. 5A provides a view from below of the external structures of said barge.
Figure 5B:
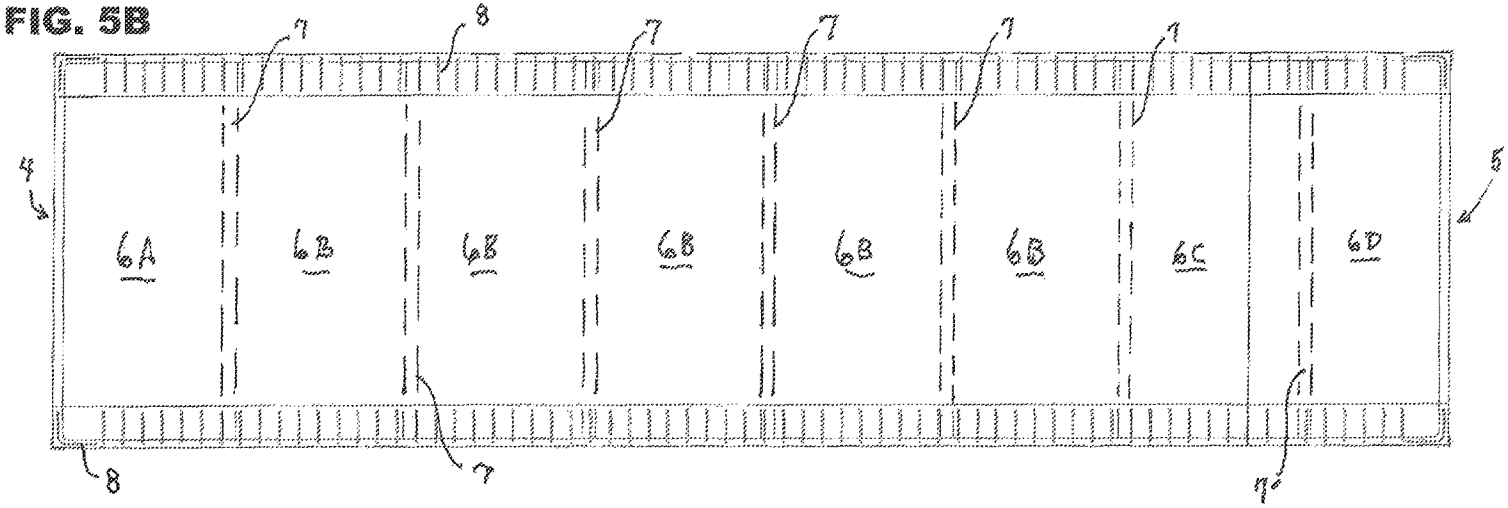
FIG. 5B provides a schematic view from below of the internal structures of said barge.
Figure 6A:
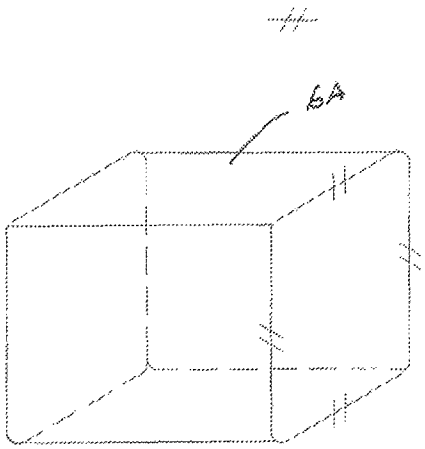
FIGS. 6A through 6D provide schematic perspective views of the styrofoam and fiberglass block members used to form the core of the embodiment illustrated.
Figure 6B:
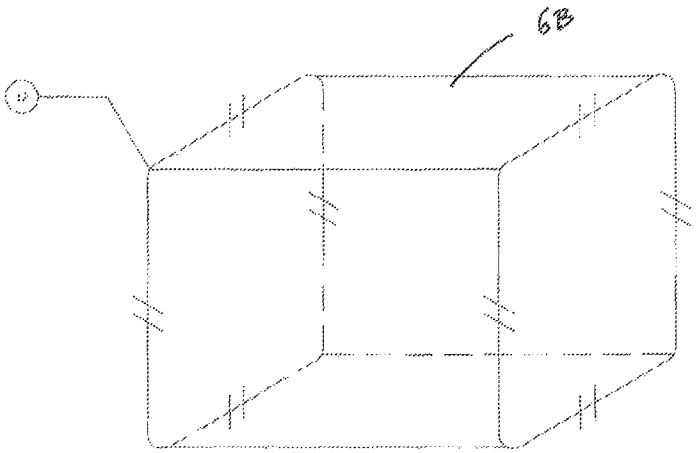
Figure 6C:
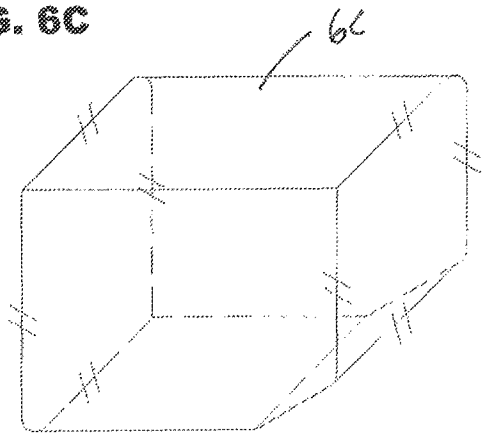
Figure 6D:
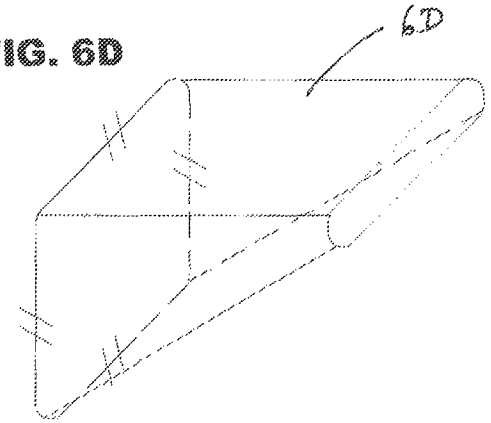
Figure 7A:
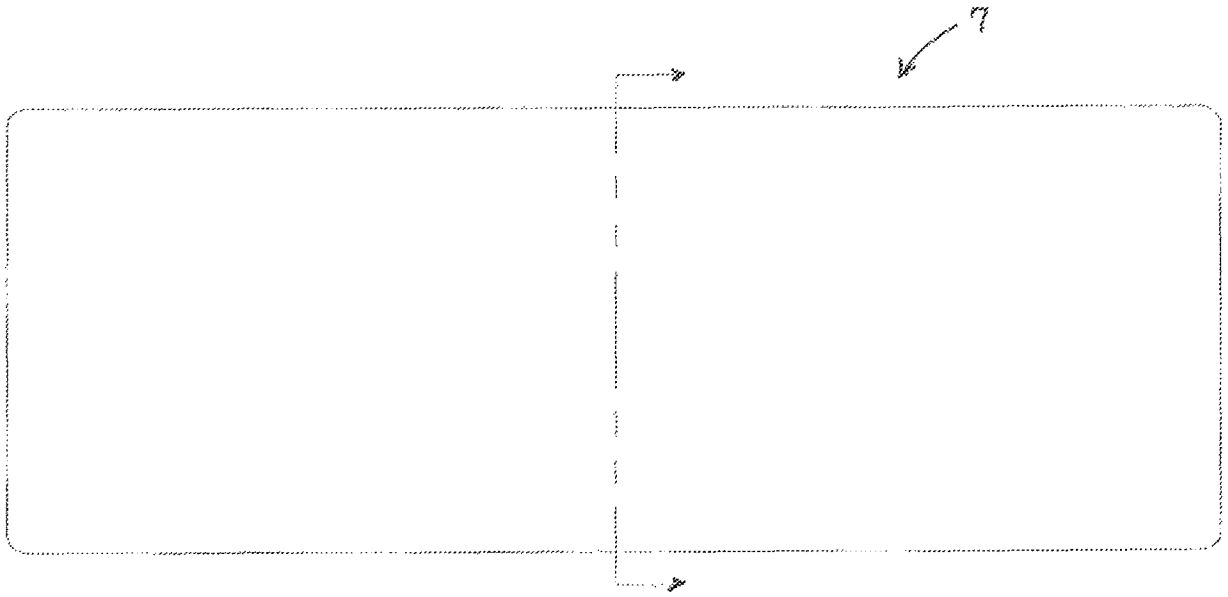
FIGS. 7A and 7B provide a plan view and a cross-sectional detail view, respectively, of the styrofoam and fiberglass stiffener walls used to form and stiffen the core of the embodiment illustrated.
Figure 7B:
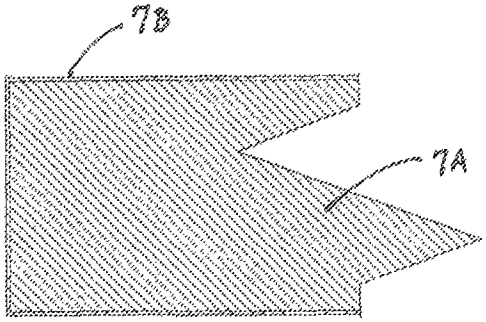
Figure 8:
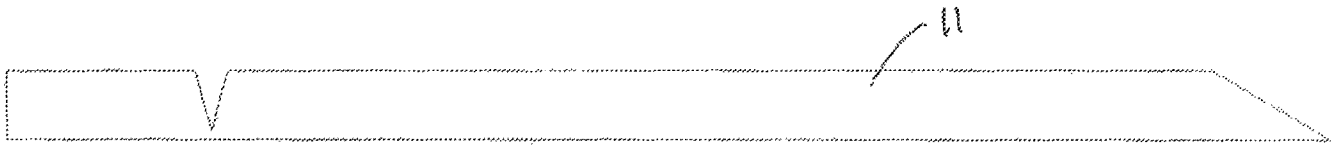
FIG. 8 provides a side view of a section of aluminum angle (as also illustrated in cross-section in FIG. 9A), with a "V" cut for bending around a corner edge.
Figure 9A:
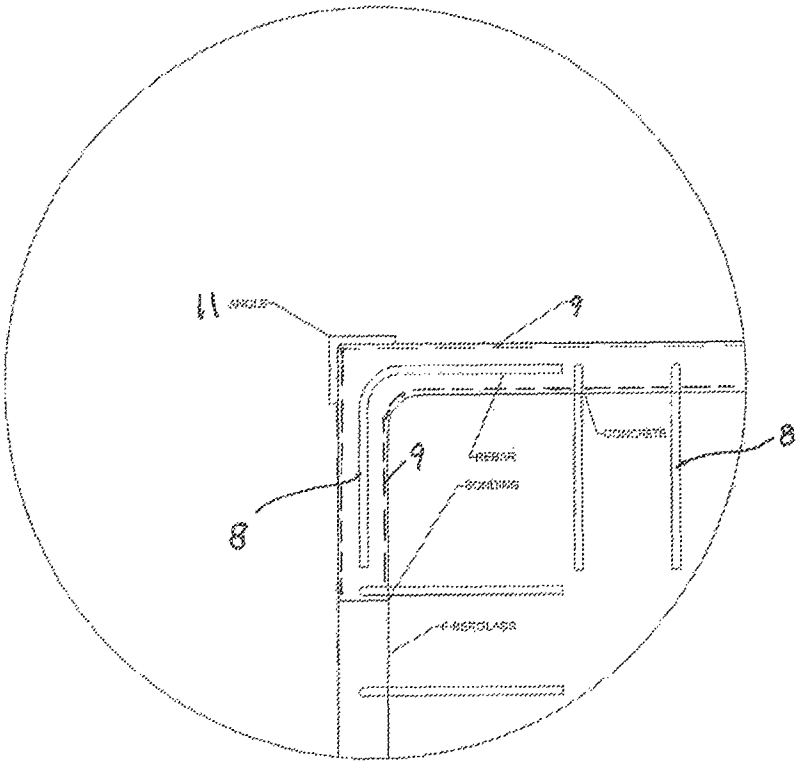
FIG. 9A provides a schematic cross-sectional detail view from above of an upper corner of said barge.
Figure 9B:
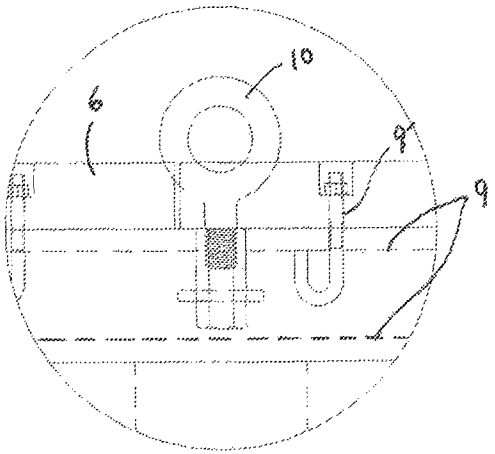
FIGS. 9B and 9C provide schematic cross-sectional detail views from the side of the manner in which a J-bolt and an eye-bolt is set in the concrete deck layer of said barge.
Figure 9D:
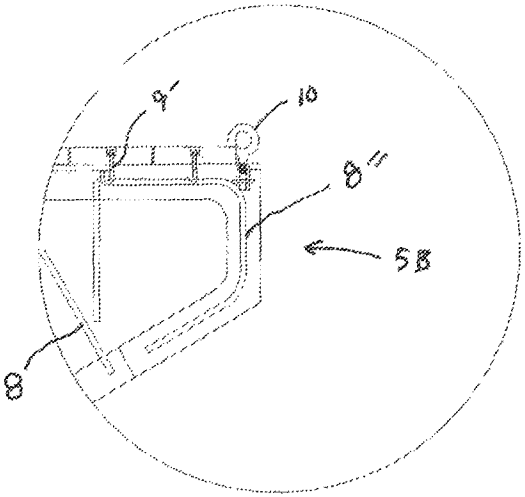
FIG. 9D provides a schematic cross-sectional detail side view of certain bow features of said barge.
Figure 9C:
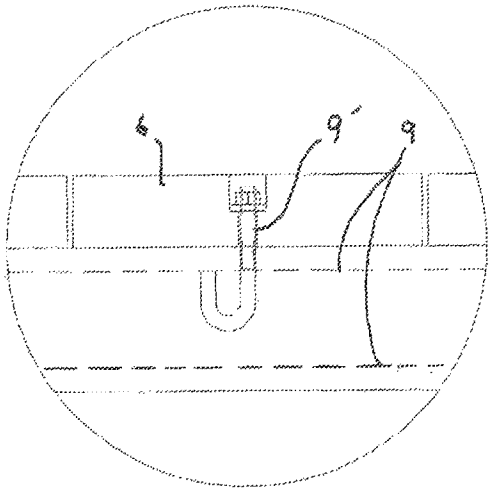
Figure 10:
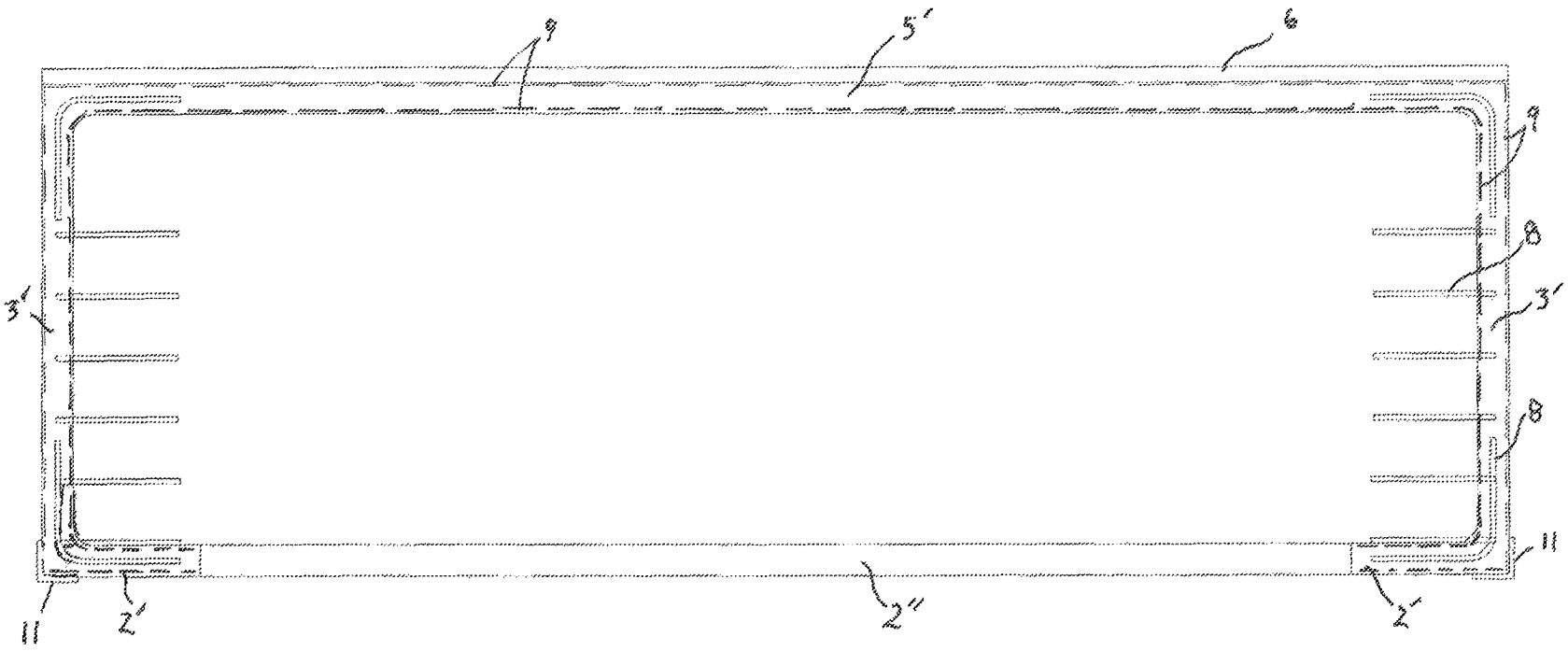
FIG. 10 provides a schematic cross-sectional side-to-side view showing internal features of said barge.

The interior features/construction of barge 1 can best be seen by review of FIGS. 1B, 2B, 3B, 4B, 5B, 6A-D, 7A-B, 9C-D, and 10. FIG. 1B provides an internal schematic top view of barge 1, while FIG. 2B provides a cross-sectional side view of barge 1. The most salient features to be noted in reviewing these drawing figures are the four different types of foam blocks 6A, 6B, 6C and 6D spanning the width of barge 1 between concrete side walls 3' and the vertical dimension of barge 1 between concrete deck layer 5' and concrete bottom layer 2' (not all of said stiffening walls 6A-6D have been labeled in ail drawing figures to avoid overcrowding of said figures). The barge spanning dimension of foam blocks 6A, 6B, 6C, and 6D in the pictured embodiment is identical: 11 feet and 5.944 inches. The front-to-back dimensions of the foam blocks are: 6A-4 feet, 0.944 inches; 6B and 6C-4 feet, 3.444 inches; 6D-3 feet, 3.944 inches. The maximum bottom-to-top spanning heights of the foam blocks are: 6A, 6B and 6C-3 feet, 5.944 inches; and 6D-2 feet, 6.319 inches. All of the four types of foam blocks shown are illustrated in FIGS. 6A, 6B, 6C and 6D with two short lines crossing edges with no fillet, and with 2 inch fillets on all unmarked edges. Each block 6A-6D is formed from styrofoam with polymer resin applied both to the exterior of the block and to the two layers of fiberglass cloth with which it is covered. Once hardened, the fiberglass layers help to stiffen the foam blocks 6A-6D as well as to render them even more impervious to water.

It will also be noted that, interspersed between each of the blocks discussed above is a width/height spanning styrofoam stiffening wall 7 (not all of said stiffening walls 7 have been labeled drawing figures to avoid overcrowding of said figures). A similar procedure is followed in forming styrofoam stiffening walls 7. Each stiffening wall 7 has a thickness of 3.838 inches and a height and side-to-side width the same as those of the blocks 6A-6D they abut. (For this reason, stiffening wall 7' between blocks 6C and 6D is somewhat shorter given the lessened height of the hull at that point). As with blocks 6A-6D, each stiffening wall 7 is formed with a styrofoam core 7A. However, to increase the rigidity of this member, polymer resin applied both to the exterior of the block and to the four layers of fiberglass cloth 7B with which it is covered. As before, once hardened, these fiberglass layers helps to stiffen walls 7/7' as well as to render them even more impervious to water.

After forming the elements (blocks 6A-6D and stiffening walls 7/7') comprising the foam core of barge 1, these elements are joined/bonded together using polymer resin to form the configuration of these elements illustrated in previously referenced drawing FIGS. 1B and 2B. However, there is a further element required in order to fully conform to the foam core configuration as seen in FIGS. 3B, 4B, 5B, and 10. As will be noted from these drawing figures, concrete bottom portions 2' do not completely span bottom 2 or bow 5 of barge 1. Most of bottom 2 and bow 5 is formed from a 3 inch thick bottom layer of foam 2" wrapped and treated (as in prior examples) by fiberglass cloth. In this iteration, using three layers of fiberglass cloth with appropriate resin application.

With the described completed foam/fiberglass core in an upright position, it can act as the inner wall(s) of a form/mold for a concrete pour in the construction of the concrete shell substantially encasing the foam core elements and forming concrete side walls 3', concrete deck layer 5', concrete bottom portions 2', and concrete stern layer 4'. However, before this shell, which comprises most of the hull of barge 1 can be poured, there are several additional steps that need to be taken. First, the exterior of the foam/fiberglass core and the interior of the outer removable mold/form members and all other surfaces that will define/form the surfaces of three inch thick concrete side walls 3', concrete deck layer 5', concrete bottom portions 2', and concrete stern portions 4' are covered with fiberglass cloth 9. (Fiberglass cloth 9 is shown schematically as a broken line adjacent inner and outer surfaces of the concrete shell described in FIGS. 9A, 9B, 9C, and 10, but is not shown or labeled in all drawing figures due to the size/scale of said drawing figures and/or to avoid overcrowding of the drawing figures). Fiberglass matting/cloth 9 is not treated/infused with resin; instead and in keeping with the novel teachings of the invention, it will be infused/saturated with concrete as part of the concrete insertion/pour, becoming part of the previously described surfaces and walls defining and surrounding the concrete shell). Second, the "L" shaped rebar reinforcement rods 8 illustrated in the drawing figures are positioned within the void to be filled with concrete so as to reinforce corners/edges between deck/sides, etc. and "U" shaped rebar reinforcement rods 8" are placed along bow plate 5B as shown in the drawing figure to reinforce this area of the concrete shell. Longer "L" shaped rebar reinforcement rods 8' with a triangulating crossbrace 8" are also placed as shown to serve as further support for outboard motor mounts 10 where outboard motors are used in order to make the barge 1 wholly or partially self-propelled.

Following this, the three inch void between the above-described forms is injected with concrete (having an 8 inch slump viscosity) at 5000 psi, allowing it to fully penetrate all areas of the mold without voids or gaps as well as to completely saturate/infuse the fiberglass matting 9 (shown intermittently. After the appropriate three inch layer of concrete is created over the top of the foam core so as to create concrete deck layer 5', all J-bolts 9', Eye-bolts 10, and other hardware to be embedded therein are "wet-set" as shown in the drawing figures (though once again, not all of said elements have been labeled to avoid overcrowding of the figures).

At this point, the concrete will be allowed to cure for an appropriate period (preferably one month), after which 2 inch by 8 inch planking 6 will be fastened into position via J-bolts and epoxy on deck 5'. It will also be epoxied into position on other exterior surfaces where it is deemed advisable to provide additional protection to the underlying materials from impacts and abrasion, all as shown in the drawing figures, Likewise, aluminum angle 11 is epoxied into position over various exterior edges as shown in the drawing figures to, once again, provide additional protection from wear and impacts to such edges.

Parts List

1 deck barge
2 dock barge bottom
2' concrete clad bottom portions
2" exterior fiberglass coated foam on bottom between concrete bottom portions
3 deck barge sides
3' concrete clad side walls
4 deck barge rear/stern
4' concrete clad stern portions
5 deck barge front/bow
5' concrete clad deck
5A inclined entry plane portion of front/bow
5B bow plate
6 Two inch by eight inch wooden planks
6' concrete clad bow portion
6A interior fiberglass coated foam block
6B interior fiberglass coated foam block
6C interior fiberglass coated foam block
6D interior fiberglass coated foam blocks
7 interior fiberglass coated stiffening walls
7A styrofoam core of stiffening wall
7B resin impregnated fiberglass cloth layers
7' interior fiberglass coated bow stiffening wall
8 "L" shaped rebar reinforcement rods
8' longer "L" shaped rebar reinforcement rods with triangulating cross-brace
8" "U" shaped rebar reinforcement rods
9 fiberglass matting
9' "J" bolts
10 eye bolts
11 aluminum angle In view of the foregoing, it should be clear that numerous changes and variations can be made without exceeding the scope of the inventive concept outlined. For example, rebar reinforcement can be via galvanized members, fiberglass coated members, stainless steel members or such other material as will be suitable in the application. It is also possible to extend the bottom-most layer of fiberglass cloth/matting all the way across the bottom of the barge. Similar changes can be made elsewhere. Accordingly, it is to be understood that the embodiment(s) of the invention herein described is/are merely illustrative of the application of the principles of the invention. Reference herein to details of the illustrated embodiment(s) is not intended to limit the scope of the claims, which recite those features regarded as essential to the invention.

The invention claimed is:

1. A vessel hull having a foam and fiberglass core encased in concrete, comprising;
- an inner core for said hull formed from a plurality of foam members encased in epoxy infused fiberglass matting and fastened together to form a vessel hull shape; and
- an outer concrete layer of said hull covering some portion of said inner core.

2. The vessel hull described in claim 1, wherein said outer concrete layer is not infused with fiberglass fibers, and further comprising at least one of:
- an inner layer of concrete infused fiberglass matting forming an interior side of said concrete layer, which layer is formed with and thereby incorporated into said concrete layer, and
- an exterior layer of concrete infused fiberglass matting forming an exterior side of said concrete layer, which layer is formed with and thereby incorporated into said concrete layer.

3. The vessel hull described in claim 1, wherein at least one of: said concrete layer does not include any metal mesh reinforcement, and said concrete layer does not include any metal reinforcement other than rebar reinforcement placed around and limited to edges of said hull.

4. The vessel hull described in claim 2, wherein at least one of: said concrete layer does not include any metal mesh reinforcement, and said concrete layer does not include any metal reinforcement other than rebar reinforcement placed around and limited to edges of said hull.

5. The vessel hull described in claim 1, wherein at least one of:
- said plurality of foam members include foam block members separated by narrower foam wall members,
- each of said plurality of foam members span the vessel hull from side-to-side within said outer concrete layer,
- each of said plurality of foam members span the vessel hull from top-to-bottom within said outer concrete layer,
- each of said plurality of foam members is covered in a plurality of layers of epoxy infused fiberglass matting, and
- each of said plurality of foam members is epoxied to adjacent foam members so as to form the inner core for said hull.

6. The vessel hull described in claim 2, wherein at least one of:
- said plurality of foam members include foam block members separated by narrower foam wall members,
- each of said plurality of foam members span the vessel hull from side-to-side within said outer concrete layer, each of said plurality of foam members span the vessel hull from top-to-bottom within said outer concrete layer, each of said plurality of foam members is covered in a plurality of layers of epoxy infused fiberglass matting, and each of said plurality of foam members is epoxied to adjacent foam members so as to form the inner core for said hull.

7. The vessel hull described in claim 3, wherein at least one of:

said plurality of foam members include foam block members separated by narrower foam wall members, each of said plurality of foam members span the vessel hull from side-to-side within said outer concrete layer, each of said plurality of foam members span the vessel hull from top-to-bottom within said outer concrete layer, each of said plurality of foam members is covered in a plurality of layers of epoxy infused fiberglass matting, and each of said plurality of foam members is epoxied to adjacent foam members so as to form the inner core to said hull.

8. The vessel hull described in claim 4, wherein at least one of:

said plurality of foam members include foam block members separated by narrower foam wall members, each of said plurality of foam members span the vessel hull from side-to-side within said outer concrete layer, each of said plurality of foam members span the vessel hull from top-to-bottom within said outer concrete layer, each of said plurality of foam members is covered in a plurality of layers of epoxy infused fiberglass matting, and each of said plurality of foam members is epoxied to adjacent foam members so as to for the inner core for said hull.

9. A method for constructing a vessel hull having a foam and fiberglass core encased in concrete, comprising:

forming an inner core for said hull from a plurality of foam members encased in epoxy infused fiberglass matting and fastened together to form a vessel hull shape;

forming an outer concrete layer of said hull around and covering some portion of said inner core;

wherein said inner core serves as the inner side of a concrete mold for the forming of said outer concrete layer.

10. The method of claim 9, wherein said outer concrete layer is not infused with fiberglass fibers, and further comprises at least one of:

an inner layer of concrete infused fiberglass matting forming an interior side of said concrete layer, which layer is formed with and thereby incorporated into said concrete layer, and an exterior layer of concrete infused fiberglass matting forming an exterior side of said concrete layer, which layer is formed with and thereby incorporated into said concrete layer.

11. The method of claim 9, wherein at least one of: said concrete layer does not include any metal mesh reinforcement, and said concrete layer does not include any metal reinforcement other than rebar reinforcement placed around and limited to edges of said hull.

12. The method of claim 10, wherein at least one of: said concrete layer does not include any metal mesh reinforcement, and said concrete layer does not include any metal reinforcement other than rebar reinforcement placed around and limited to edges of said hull.

13. The vessel hull described in claim 9, wherein at least one of:

said plurality of foam members include foam block members separated by narrower foam wall members, each of said plurality of foam members span the vessel hull from side-to-side within said outer-concrete layer, each of said plurality of foam members span the vessel hull from top-to-bottom within said outer concrete layer, each of said plurality of foam members is covered in a plurality of layers of epoxy infused fiberglass matting, and each of said plurality of foam members is epoxied to adjacent foam members so as to form the inner core for said hull.

14. The vessel hull described in claim 10, wherein at least one of:

said plurality of foam members include foam block members separated by narrower foam wall members, each of said plurality of foam members span the vessel hull from side-to-side within said outer concrete layer, each of said plurality of foam members span the vessel hull from top-to-bottom within said outer concrete layer, each or said plurality of foam members is covered in a plurality of layers of epoxy infused fiberglass matting, and each of said plurality of foam members is epoxied to adjacent foam members so as to form the inner core for said hull.

15. The vessel hull described in claim 11, wherein at least one of:

said plurality of foam members include foam block members separated by narrower foam wall members, each of said plurality of foam members span the vessel hull from side-to-side within said outer concrete layer, each of said plurality of foam members span the vessel hull from top-to-bottom within said outer concrete layer, each of said plurality of foam members is covered in a plurality of layers of epoxy infused fiberglass matting, and each of said plurality of foam members is epoxied to adjacent foam members so as to form the inner core for said hull.

16. The vessel hull described in claim 12, wherein at least one of:

said plurality of foam members include foam block members separated by narrower foam wall members, each of said plurality of foam members span the vessel hull from side-to-side within said outer concrete layer, each of said plurality of foam members span the vessel hull from top-to-bottom within said outer concrete layer, each of said plurality of foam members is covered in a plurality of layers of epoxy infused fiberglass matting, and each of said plurality of foam members is epoxied to adjacent foam members so as to form the inner core for said hull.

* * * * *